US005231845A

United States Patent [19]

Sumitani et al.

[11] Patent Number: 5,231,845

[45] Date of Patent: Aug. 3, 1993

[54] AIR CONDITIONING APPARATUS WITH DEHUMIDIFYING OPERATION FUNCTION

[75] Inventors: Shigeto Sumitani; Takeshi Sato, both of Fuji, Japan

[73] Assignee: Kabushiki Kaisha Toshiba, Kawasaki, Japan

[21] Appl. No.: 910,750

[22] Filed: Jul. 8, 1992

[30] Foreign Application Priority Data

Jul. 10, 1991 [JP] Japan ..... 3-170088

[51] Int. Cl.[5] ..... F25B 13/00

[52] U.S. Cl. ..... 62/160; 62/173; 62/176.6; 62/181; 62/229; 165/29; 236/44 C

[58] Field of Search ..... 62/160, 176.1, 176.5, 62/176.6, 173, 180, 181, 183, 184, 229, 186; 165/29; 236/44 R, 44 A, 44 C

[56] References Cited

U.S. PATENT DOCUMENTS

| | | | |
|---|---|---|---|
| 3,779,031 | 12/1973 | Akiyama et al. | 62/160 |
| 4,448,597 | 5/1984 | Kuwabara et al. | 62/176.6 |
| 4,457,137 | 7/1984 | Kohzuma | 62/160 X |
| 4,482,008 | 11/1984 | Nomaguchi et al. | 62/160 X |
| 4,905,894 | 3/1990 | Noguchi | 237/2 B |
| 4,938,032 | 7/1990 | Mudford | 62/160 |
| 4,984,433 | 1/1991 | Worthington | 62/176.6 X |
| 5,044,425 | 9/1991 | Tatsumi et al. | 62/181 X |

FOREIGN PATENT DOCUMENTS

| | | |
|---|---|---|
| 52-45418 | 11/1977 | Japan . |
| 60-33454 | 2/1985 | Japan . |
| 1395194 | 5/1975 | United Kingdom . |

*Primary Examiner*—Harry B. Tanner

*Attorney, Agent, or Firm*—Cushman, Darby & Cushman

[57] ABSTRACT

An electronic expansion valve is provided between first and second indoor heat exchangers. At the time of cooling operation, the electronic expansion valve is fully opened with the result that the first and second indoor heat exchangers are communicated with each other. At the time of dehumidifying operation, the opening of the electronic expansion valve is decreased to apply the effect of pressure reduction between the indoor heat exchangers, so that the first indoor heat exchanger functions as a reheater and the second indoor heat exchanger functions as an evaporator. The air in the room is cooled and dehumidified by the second indoor heat exchanger and then discharged into the room after being reheated by the first indoor heat exchanger. At the time of the dehumidifying operation, controlling the speed of the outdoor fan permits the temperature of the air discharged into the room to be varied.

9 Claims, 12 Drawing Sheets

AIR CONDITIONING APPARATUS WITH DEHUMIDIFYING OPERATION FUNCTION

BACKGROUND OF THE INVENTION

1. Field of the Invention

The present invention relates to an air conditioning apparatus having a dehumidifying operation function of removing moisture from air in a room.

2. Description of the Related Art

There is known an air conditioning apparatus which is equipped with two indoor heat exchangers connected by a parallel combination of an expansion valve and a two-way valve.

With this type of air conditioning apparatus, opening the two-way valve to thereby cause the flow of a refrigerant to bypass the expansion valve permits the indoor heat exchangers to function as a single heat exchanger. On the other hand, closing the two-way valve to thereby apply the expansion valve between the indoor heat exchangers permits each of the heat exchangers to serve as a separate heat exchanger.

Thus, opening the two-way valve so as to cause each of the indoor heat exchangers to serve as an evaporator will perform cooling operation. Opening the two-way valve so as to cause each of the heat exchangers to serve as a condenser will perform heating operation. Closing the two-way valve to thereby cause one of the indoor heat exchangers to serve as a condenser (a reheater) and the other to serve as an evaporator will perform dehumidifying operation. That is, the air in the room is cooled and dehumidified by the evaporator and then discharged into the room after being reheated by the condenser.

An example of such an air conditioning apparatus equipped with functions of cooling operation, heating operation and dehumidifying operation is disclosed in Japanese Examined Patent Publication No. 52-45418. Also, there is disclosed in U.S. Pat. No. 4,905,894 a refrigerant heating type air conditioner that is equipped with a refrigerant heating device and performs heating operation by utilizing heat of combustion by the heating device.

A problem with such an air conditioning apparatus in which the functions of the two indoor heat exchangers are switched by opening and closing of the two-way valve as described above is that the refrigerant produces a loud sound when the two-way valve is opened or closed. This sound will make people in the room unpleasant.

SUMMARY OF THE INVENTION

It is an object of the present invention to provide an air conditioning apparatus which can prevent the production of an unpleasant refrigerant sound and maintain a room at a most comfortable temperature at the time of dehumidifying operation.

According to the present invention there is provided an air conditioning apparatus with a function of dehumidifying operation comprising:

a compressor for taking in a refrigerant and discharging it after compression;

an outdoor heat exchanger for exchanging heat between the refrigerant and outdoor air;

an outdoor fan for sending outdoor air to the outdoor heat exchanger;

pressure reducing unit for reducing the pressure of the refrigerant;

a first indoor heat exchanger for exchanging heat between the refrigerant and indoor air;

an electronic expansion valve having a variable opening;

a second heat exchanger for exchanging heat between the refrigerant and indoor air;

an indoor fan for circulating indoor air through the first and second indoor heat exchangers;

a control unit for performing a cooling operation by returning the refrigerant discharged out of the compressor back to the compressor through the outdoor heat exchanger, the pressure reducing unit, the first indoor heat exchanger, the electronic expansion valve, and the second indoor heat exchanger, and fully opening the electronic expansion valve;

a control unit for performing a dehumidifying operation by returning the refrigerant discharged out of the compressor back to the compressor through the outdoor heat exchanger, the first indoor heat exchanger, the electronic expansion valve, and the second indoor heat exchanger, and decreasing the opening of the electronic expansion valve; and a control unit for, at the time of the dehumidifying operation, controlling the speed of the outdoor fan to thereby regulate the temperature of air discharged into the room.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE PREFERRED EMBODIMENTS

Figure 1:
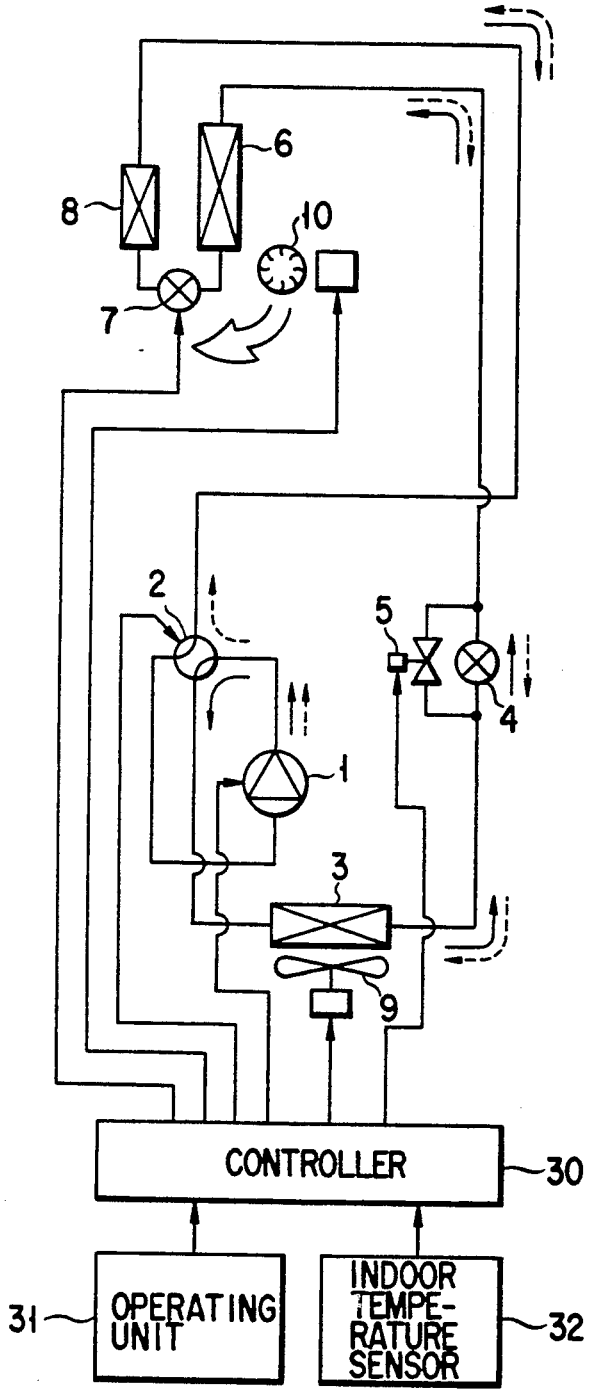
FIG. 1 illustrates a refrigeration cycle and a control circuit according to a first embodiment of the present invention.

Referring now to FIG. 1, a compressor 1 takes in a refrigerant and discharges it after compression. The discharge port of the compressor 1 is pipe-connected with an outdoor heat exchanger 3 via a four-way valve 2. The outdoor heat exchanger 3 exchanges heat between the refrigerant and the outdoor air. To the outdoor heat exchanger 3 is pipe-connected a first indoor heat exchanger 6 through a means 4 of reducing the pressure of the refrigerant, e.g., an expansion valve. A two-way valve 5 is pipe-connected in parallel with the expansion valve 4. The first indoor heat exchanger 6 is adapted to exchange heat between the refrigerant and the air in the room.

With the first indoor heat exchanger 6 is pipe-connected a second indoor heat exchanger 8 through an electronic expansion valve 7. With the second indoor heat exchanger 8 is pipe-connected the inlet of the compressor 1 through the four-way valve 2. The electronic expansion valve 7 is a pulse motor valve whose opening varies continuously in accordance with the number of drive pulses applied thereto. Hereinafter, the electronic expansion valve 7 is referred to as PMV.

An outdoor fan 9 is installed in the ventilating path to the outdoor heat exchanger 3. The fan 9 sends outdoor air to the outdoor heat exchanger 3 and is capable of continuously changing its rotational speed. As a motor for driving the outdoor fan 9, use may be made of a direct-current motor whose rotational speed can be controlled by adjusting the magnitude of a drive voltage or an alternating-current motor whose rotational speed is controlled by the phase control of drive voltage.

An indoor fan 10 is provided in the ventilating path to the indoor heat exchangers 6 and 8. The fan 10 causes the air in the room to pass through the first and second heat exchangers 6 and 8 for circulation through the room.

Figure 2:
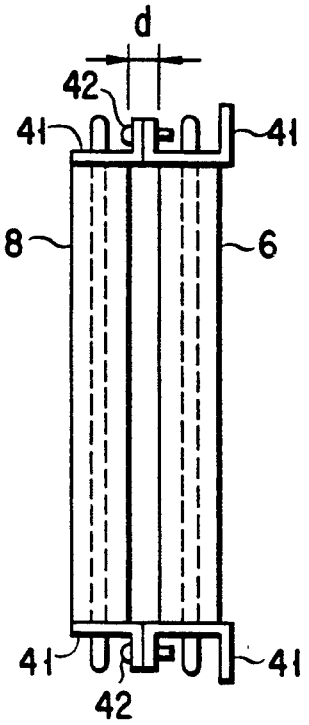
FIG. 2 is a top view of the indoor heat exchangers in the first embodiment.

FIG. 2 is a top view of the indoor heat exchangers 6 and 8. That is, brackets 41 are fixed to the sides of each of the heat exchangers 6 and 8, and the corresponding brackets 41 are coupled by screws 42. In coupling the brackets spacing d is secured between the indoor heat exchangers 6 and 8. The spacing d is intended to avoid the heat transfer between the indoor heat exchangers 6 and 8.

Figure 3:
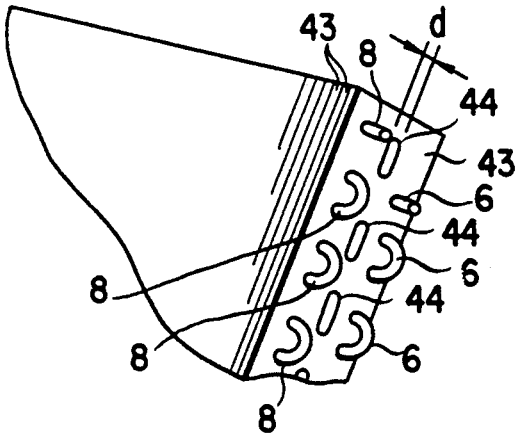
FIG. 3 is a perspective view, with portions broken away, of a modification of the indoor heat exchangers of the first embodiment.

The indoor heat exchangers 6 and 8 may be arranged such that, as shown in FIG. 3, they are supported by a large number of fins 43, and a large number of slits 44 are formed in each of the fins 43. Each slit is adapted to avoid the heat transfer between the heat exchangers 6 and 8.

Reference numeral 30 denotes a controller which comprises a microcomputer and its associated peripheral circuits and controls the whole air-conditioning apparatus. To the controller 30 are connected a remote control type operating unit 31, an indoor temperature sensor 32, the compressor 1, the four-way valve 2, the two-way valve 5, the PMV 7, the outdoor fan 9, and the indoor fan 10. The indoor temperature sensor 32 senses temperature Ta of the air in the room.

The controller 30 is equipped with the following functional means.

[1] A means of performing cooling operation by operating the compressor 1, returning the refrigerant discharged out of the compressor 1 back to the compressor 1 through four-way valve 2, outdoor heat exchanger 3, expansion valve 4 (in this case, the two-way valve 5 is closed), first indoor heat exchanger 6, PMV 7, second indoor heat exchanger 8, and four-way valve 2, and fully opening the PMV 7.

[2] A means of performing dehumidifying operation by operating the compressor 1, returning the refrigerant discharged out of the compressor 1 back to the compressor 1 through four-way valve 2, outdoor heat exchanger 3, two-way valve 5, first indoor heat exchanger 6, electronic expansion valve 7, second indoor heat exchanger 8, and four-way valve 2, and decreasing the opening of the electronic expansion valve 7.

[3] A means of, at the time of dehumidifying operation, controlling the speed of the outdoor fan 9 to thereby regulate the temperature of the dehumidified air.

[4] A means of performing heating operation by switching the four-way valve 2, operating the compressor 1, returning the refrigerant discharged out of the compressor 1 back to the compressor 1 through four-way valve 2, second indoor heat exchanger 8, electronic expansion valve 7, first indoor heat exchanger 6, expansion valve 4 (in this case, the two-way valve 5 is closed), outdoor heat exchanger 3, and four-way valve 2, and fully opening the electronic expansion valve 7.

Figure 4A:
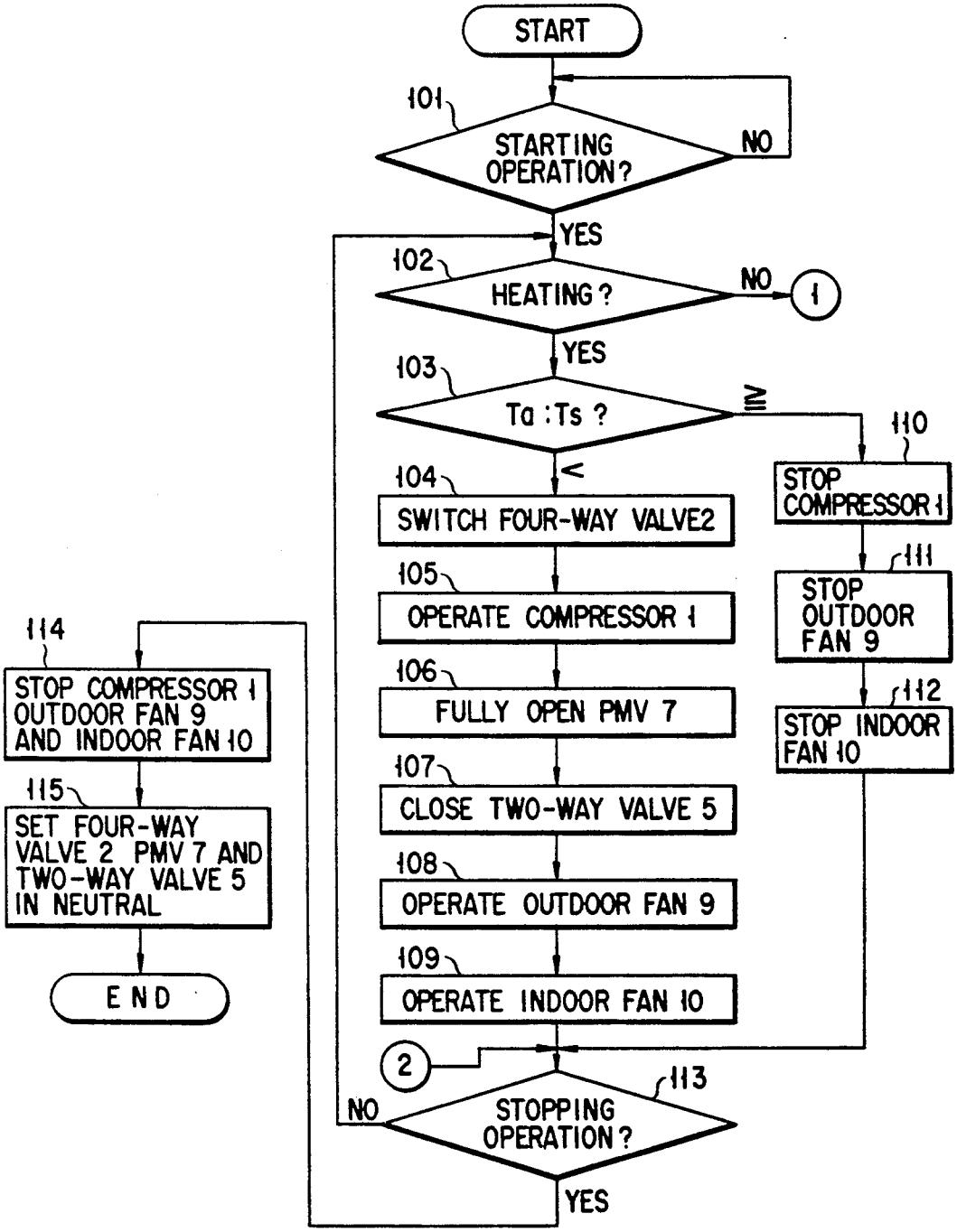
FIGS. 4A and 4B are a flowchart illustrating the operation of the first embodiment.
Figure 4B:
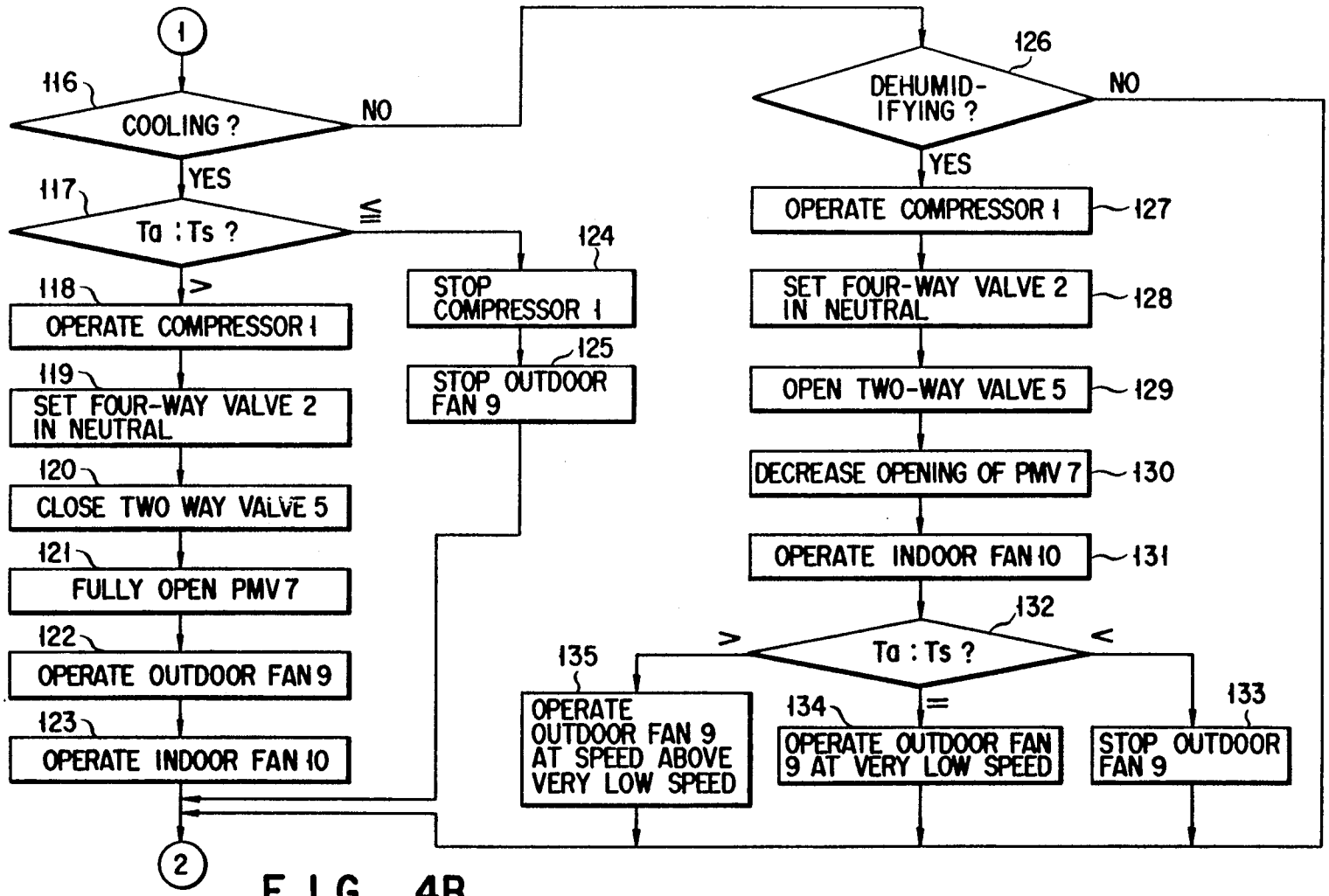

Next, the above operation will be described with reference to a flowchart shown in FIGS. 4A and 4B.

Suppose that a heating operation mode and a desired room temperature Ts are set, and a starting operation is performed at the operating unit 31 (steps 101, 102). Hereinafter, Ts is referred to as the set value.

If, at this point, the room temperature Ta sensed by the sensor 32 is lower than the set value Ts ($Ta < Ts$, in step 103), then the four-way valve 2 is switched, the compressor 1 is operated, the PMV 7 is fully opened, the two-way valve 5 is closed, the outdoor fan 9 is operated, and the indoor fan 10 is operated (steps 104 to 109).

As indicated by broken arrows in FIG. 1, therefore, the refrigerant is discharged out of the compressor 1 and then enters the second indoor heat exchanger 8 through the four-way valve 2. The refrigerant that has entered the second heat exchanger 8 will also enter the first indoor heat exchanger 6 through the electronic expansion valve 7 that is now fully opened. In the indoor heat exchangers 6 and 8, the refrigerant emits heat to the air in the room and then liquefies.

The refrigerant from the indoor heat exchangers 6 and 8 is subjected to pressure reduction in the expansion valve 4 so that it can be easily vaporized and then enters the outdoor heat exchanger 3. In the outdoor heat exchanger 3, the refrigerant absorbs heat of outdoor air and then vaporizes. The refrigerant from the outdoor heat exchanger 3 is taken into the compressor 1 through the four-way valve 2. That is, a heating cycle is made.

In that way, the indoor heat exchangers 6 and 8 serve as condensers, and the outdoor heat exchanger 3 serves as an evaporator, whereby the room is heated.

When the room temperature Ta rises to or above the set value Ts ($Ta \geqq Ts$ in step 103), the compressor 1, the outdoor fan 9 and the indoor fan 10 are stopped (steps 110 to 112). That is, the heating operation is interrupted.

Subsequently, when the room temperature Ta falls below the set value Ts ($Ta < Ts$ in step 103), the heating operation is resumed.

When a stopping operation is performed at the operating unit 31 (step 113), the compressor 1, the outdoor fan 9 and the indoor fan 10 are brought to a stop (step 14). Further, the four-way valve 2, the PMV 7 and the two-way valve 5 are set in neutral (step 115). That is, the heating operation is stopped.

Suppose that a cooling operation mode is set and, moreover, a starting operation is performed at the operating unit 31 (steps 101, 116).

If, at this point, the room temperature Ta sensed by the indoor temperature sensor 32 is higher than the set value Ts (Ta>Ts in step 117), then the compressor 1 is operated (step 118), the four-way valve 2 is set in neutral (step 119), the two-way valve 5 is closed (step 120), the PMV 7 is fully opened (step 121), the outdoor fan 9 is operated (step 122), and the indoor fan 10 is operated (step 123).

In this case, as indicated by solid arrows in FIG. 1, the refrigerant is discharged out of the compressor 1 and then enters the outdoor heat exchanger 3 via the four-way valve 2. The refrigerant from the outdoor heat exchanger 3 is subjected to pressure reduction in the expansion valve 4 so that it can be easily be vaporized and then enters the first indoor heat exchanger 6. The refrigerant also enters the second indoor heat exchanger 8 via the PMV 7 that is in the fully open state. In the heat exchangers 6 and 8, the refrigerant absorbs heat from the air in the room and then vaporizes. The refrigerant which has passed through the indoor heat exchangers 6 and 8 are taken into the compressor 1 through the four-way valve 2. That is, a cooling cycle is made.

In that way, the outdoor heat exchanger 3 serves as a condenser, while the indoor heat exchangers 6 and 8 serve as evaporators, whereby the room is cooled.

When the room temperature Ta falls to or below the set value Ts (Ta≦Ts in step 117), the compressor 1 and the outdoor fan 9 are stopped (steps 124 and 125). That is, the cooling operation is interrupted.

Subsequently, when the room temperature Ta goes higher than the set value Ts (Ta>Ts in step 117), the cooling operation is resumed.

Suppose that a dehumidifying operation mode is set at the operating unit 31 (step 126).

Then, the compressor 1 is put into operation, the four-way valve 2 is set in neutral, the two-way valve 5 is opened, the opening of the PMV 7 is decreased, and the indoor fan 10 is operated (steps 127 to 131).

As a result, the refrigerant is discharged out of the compressor 1 and then enters the outdoor heat exchanger 3 through the four-way valve 2. The refrigerant from the outdoor heat exchanger 3 passes through the two-way valve 5 with the four-way valve 4 bypassed and then enters the indoor heat exchanger 6. In the heat exchanger 6, the refrigerant emits heat to the air in the room and then liquefies. The refrigerant which has passed through the heat exchanger 6 is subjected to pressure reduction in the PMV 7 so that it can be easily vaporized and then enters the second indoor heat exchanger 8. In the heat exchanger 8, the refrigerant absorbs heat from the air in the room and then vaporizes. The refrigerant which has passed through the second indoor heat exchanger 8 is taken into the compressor 1 through the four-way valve 2.

In this way, the dehumidifying cycle is made in which the first indoor heat exchanger 6 acts as a condenser (reheater), and the second indoor heat exchanger 8 acts as an evaporator. The air in the room is cooled and dehumidified by the second indoor heat exchanger 8, reheated by the first indoor heat exchanger 6 and then discharged into the room.

At the time of the dehumidifying operation, a comparison is made between the room temperature Ta sensed by the sensor 32 and the set value Ts (step 132). This permits a selection to be made out of a dehumidifying operation on the heating side, a dehumidifying operation at a desired temperature (isothermal operation), and a dehumidifying operation on the cooling side.

For example, when the room temperature Ta is lower than the set value Ts (Ta<Ts), the dehumidifying operation on the heating side is selected. With this type of dehumidifying operation, the outdoor fan 9 is stopped (step 133). In this case, since no outdoor air passes through the outdoor heat exchanger 3, the heat radiation from the refrigerant decreases, and the quantity of heat applied to the reheater (first indoor heat exchanger 6) correspondingly increases. Thus, the air cooled and dehumidified by the first indoor heat exchanger 8 is heated to a temperature higher than the room temperature Ts by the reheater and then discharged into the room.

When the room temperature Ta is substantially equal to the set value Ts (Ta=Ts), the isothermal dehumidifying operation is selected. With this type of dehumidifying operation, the outdoor fan 9 is operated at a very low speed (step 134). In this case, the heat radiation from the refrigerant in the outdoor heat exchanger 3 slightly increases, and the quantity of heat applied to the reheater (the first indoor heat exchanger 6) correspondingly decreases. Therefore, the air cooled and dehumidified by the first indoor heat exchanger 8 is heated to a temperature substantially equal to the room temperature Ta and then discharged into the room.

When the room temperature Ta is higher than the set value Ts (Ta>Ts), the dehumidifying operation on the cooling side is selected. With this type of dehumidifying operation, the outdoor fan 9 is operated at a speed higher than the very low speed (step 134). In this case, the heat radiation from the refrigerant in the outdoor heat exchanger 3 increases, and the quantity of heat applied to the reheater (the first indoor heat exchanger 6) correspondingly decreases. Therefore, the air cooled and dehumidified by the first indoor heat exchanger 8 is discharged into the room after being slightly heated.

As described above, at the time of the dehumidifying operation, by controlling the speed of the outdoor fan 9 so as to regulate the temperature of the dehumidified air (air discharged into the room), the room can be maintained at a most comfortable temperature. Besides, since the range of variations of the speed of the outdoor fan 9 is narrow, the temperature of the room is allowed to vary gently. This is also comfortable.

Moreover, since the functions of the first and second indoor heat exchangers 6 and 8 are changed by adjusting the opening of the PMV 7, the flow of the refrigerant will be slow when their functions are changed, producing no unpleasant refrigerant sound.

Furthermore, since the dehumidifying operation on the heating side can be performed without switching the four-way valve 2, the generation of refrigerant sound resulting from switching of the four-way valve 2 can be avoided.

In the first embodiment, the expansion valve 4 may be replaced with an electronic expansion valve. In this case, the opening of the electronic expansion valve is decreased at the times of the cooling and heating operations but is fully opened at the time of the dehumidifying operation. This arrangement will eliminate the need for the two-way valve 5.

Figure 5:
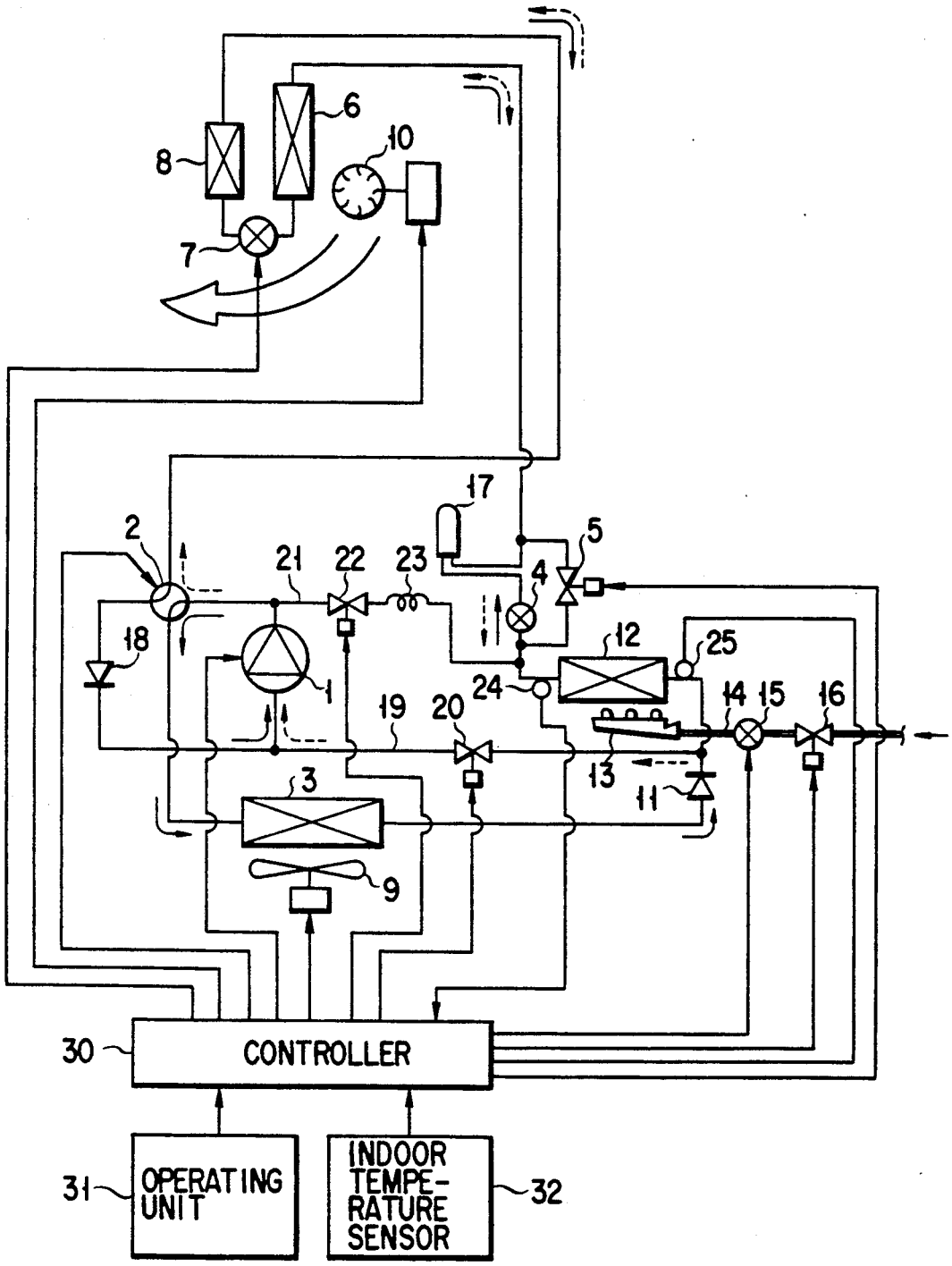
FIG. 5 illustrates a refrigeration cycle and a control circuit according to a second embodiment of the present invention.

Next, a second embodiment of the present invention will be described with reference to FIG. 5. In FIG. 5, like reference numerals are used to designate corresponding parts to those in FIG. 1, and their detailed description is omitted.

As shown in FIG. 5, a series combination of a check valve 11 and a refrigerant heater 12 are interposed between the outdoor heat exchanger 3 and the expansion valve 4. The heater 12 is equipped with a gas burner 13 which is connected with a fuel supply source (not shown) through a fuel pipe 14. The fuel pipe 14 is equipped with a proportional control valve 15 and a two-way valve 16. The proportional control valve 15 varies its opening in proportion to the level of an input voltage.

A liquid receiver 17 is pipe-connected in series with the expansion valve 4. A check valve 18 is pipe-connected between the four-way valve 2 and the inlet port of the compressor 1. A bypass pipe 19 has its one end connected with the pipe between the check valve 11 and the refrigerant heater 12 and its other end connected with the inlet port of the compressor 1. The bypass pipe 19 is equipped with a two way valve 20.

A bypass pipe 21 has its one end connected with the outlet port of the compressor 1 and its other end connected with the pipe between the refrigerant heater 12 and the expansion valve 4. The bypass pipe 21 is equipped with a two-way valve 22 and a capillary tube 23.

A temperature sensor 24 is mounted on the pipe between the refrigerant heater 12 and the expansion valve 4. A temperature sensor 25 is mounted on the pipe between the check valve 11 and the refrigerant heater 12.

To the controller 30 are connected operating unit 31, indoor temperature sensor 32, compressor 1, four-way valve 2, two-way valve 5, PMV 7, outdoor fan 9, indoor fan 10, proportional control valve 15, two-way valve 16, two-way valve 20, and two-way valve 22.

The controller 30 is equipped with the following functional means.

[1] A means of performing cooling operation by operating the compressor 1, returning the refrigerant discharged out of the compressor 1 back to the compressor 1 through two-way valve 2, outdoor heat exchanger 3, check valve 11, refrigerant heater 12, expansion valve 4 (two-way valve 5 is closed), liquid receiver 17 (two-way valve 5 is closed), first indoor heat exchanger 6, PMV 7, second indoor heat exchanger 8, four-way valve 2, and check valve 18, and fully opening the PMV 7 with the refrigerant heater 12 stopped, i.e., the gas burner 13 non-fired.

[2] A means of performing dehumidifying operation by operating the compressor 1, returning the refrigerant discharged out of the compressor 1 back to the compressor 1 through four-way valve 2, outdoor heat exchanger 3, check valve 11, refrigerant heater 12, two-way valve 5, first indoor heat exchanger 6, PMV 7, second indoor heat exchanger 8, four-way valve 2, and check valve 18, and decreasing the opening of the PMV 7.

[3] A means of, at the time of dehumidifying operation, regulating the temperature of the dehumidified air by controlling the speed of the outdoor fan 9 and the operation of the refrigerant heater 12 (firing of the burner 13).

[4] A means of, at the time of the dehumidifying operation, stopping the operation when the temperature (the temperature of the refrigerant going out of the heater 12) sensed by the sensor 24 is abnormally high.

[5] A means of performing heating operation by operating the compressor 1, returning the refrigerant discharged out of the compressor 1 back to the compressor 1 through four-way valve 2, second indoor heat exchanger 8, PMV 7, first indoor heat exchanger 6, liquid receiver 17 (two-way valve 5 is closed), expansion valve 4 (two way valve 5 is closed), refrigerant heater 12, and bypass pipe 19 (two-way valve 20 is opened), and fully opening the PMV 7 with the refrigerant heater 12 operated.

[6] A means of, at the time of heating operation, detecting the degree of superheat of the refrigerant that corresponds to a difference between the temperature of the refrigerant entering the heater 12, sensed by the sensor 24, and the temperature of the refrigerant going out of the heater 12, sensed by the sensor 25.

[7] A means of controlling the quantity of heat applied to the refrigerant heater 12 by controlling the opening of the proportional control valve 15 so that the degree of superheat should be kept constant.

Figure 6A:
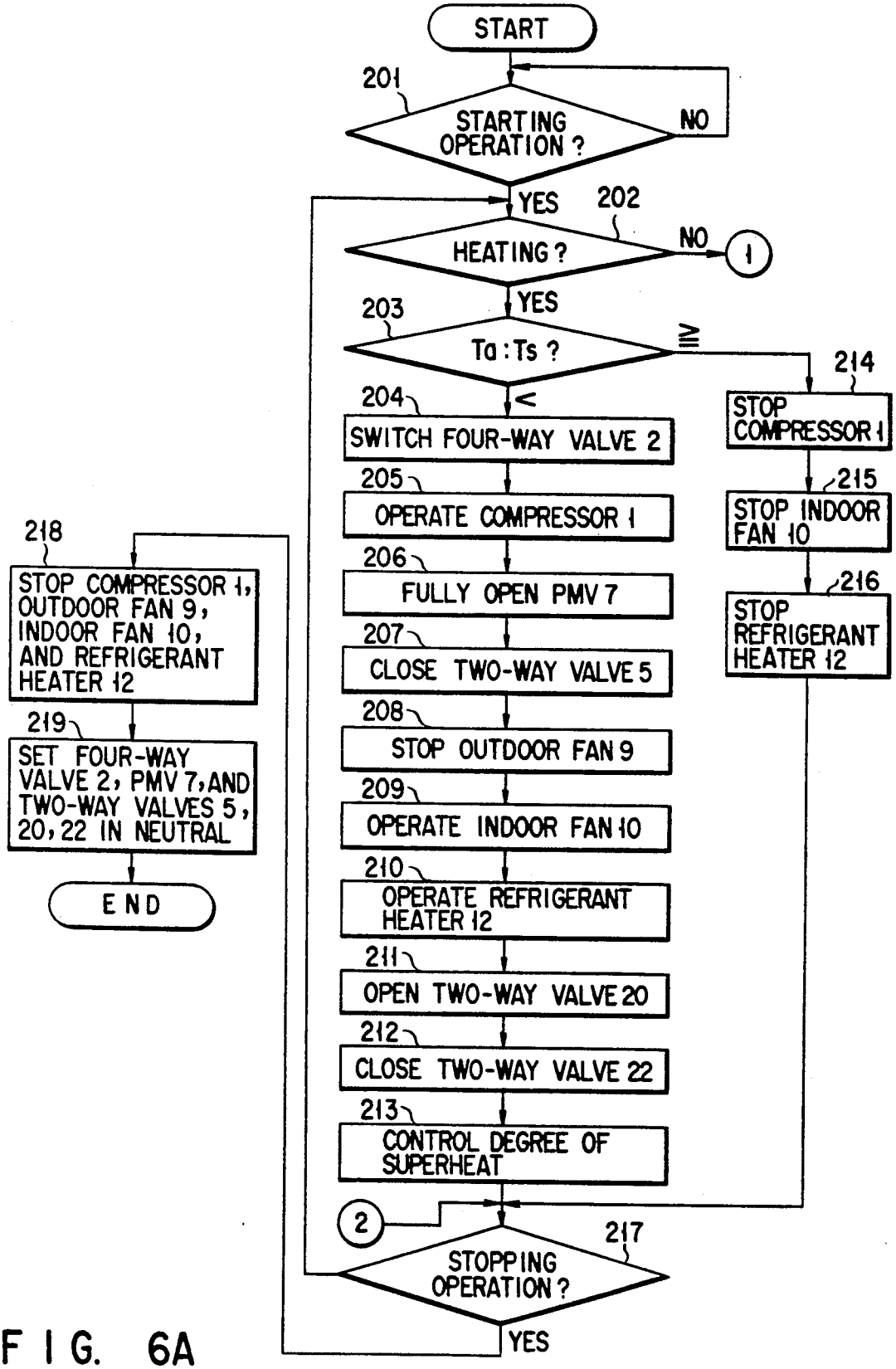
FIGS. 6A, 6B and 6C are a flowchart illustrating the operation of the second embodiment.
Figure 6B:
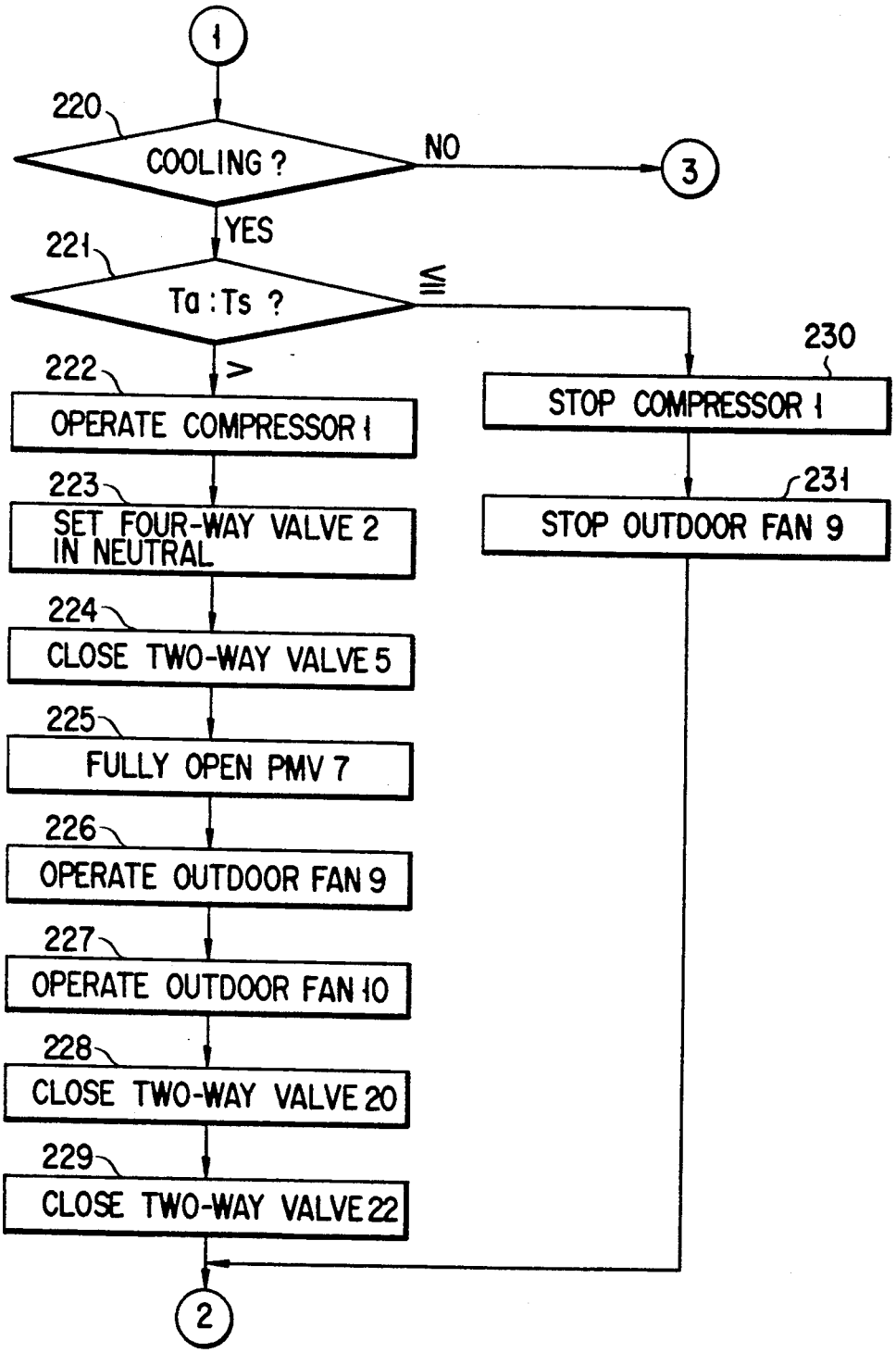
Figure 6C:
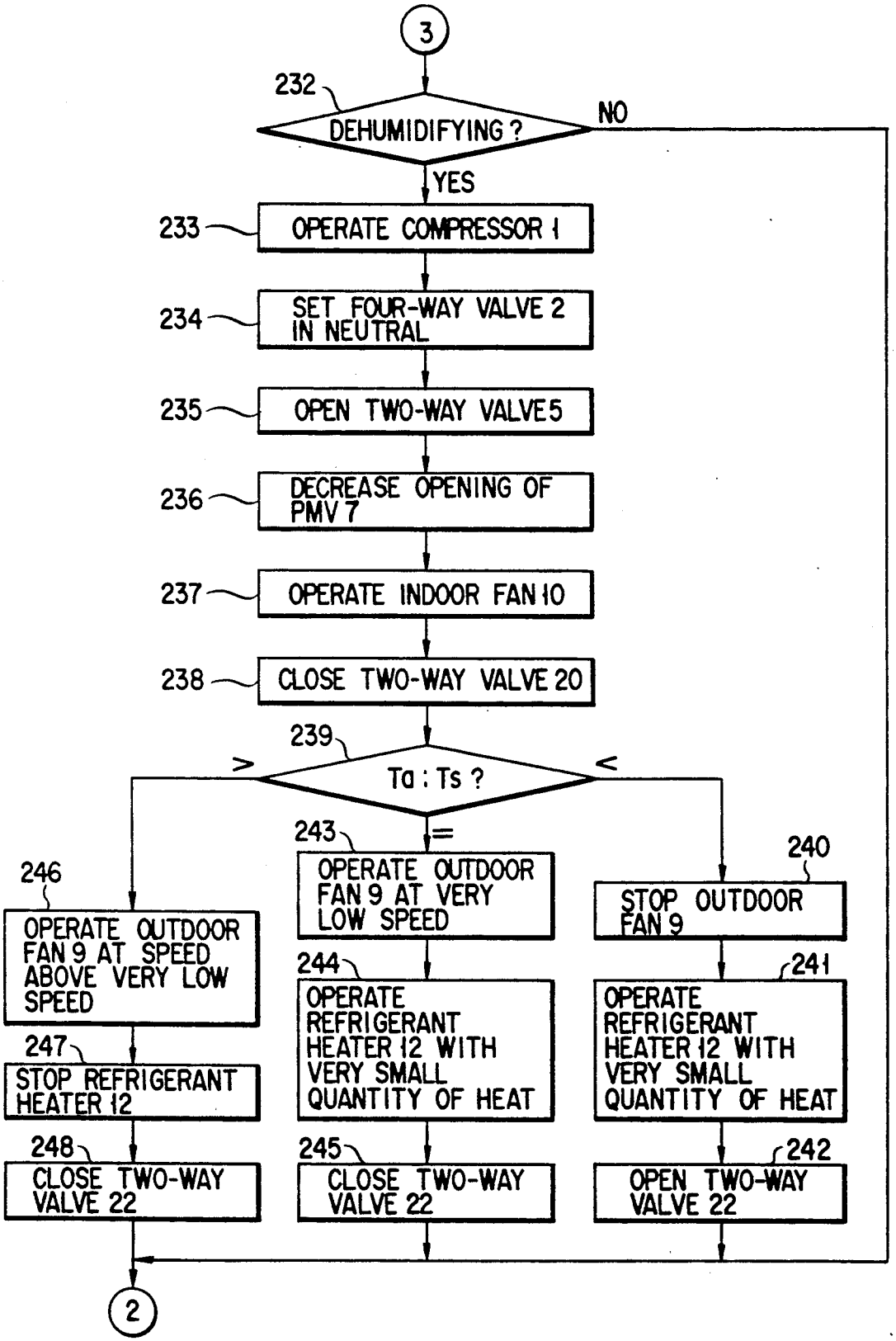

Next, the operation of the above system will be described with reference to a flowchart of FIGS. 6A, 6B and 6C.

Suppose that a heating operation mode and a desired room temperature Ts is set, and a starting operation is performed at the operating unit 31 (steps 201 and 202). Hereinafter, Ts is referred to as the set value.

If, at this point, the room temperature Ta sensed by the indoor temperature sensor 32 is lower than the set value Ts ($Ta<Ts$ in step 203), then the four-way valve 2 is switched, the compressor 1 is operated, the PMV 7 is fully opened, the two-way valve 5 is closed, the outdoor fan 9 is stopped, the indoor fan 10 is operated, the refrigerant heater 12 is operated (the burner 13 is fired), the two-way valve 20 is opened, and the two-way valve 22 is closed (steps 204 to 212).

As indicated by broken arrows in FIG. 5, therefore, the refrigerant is discharged out of the compressor 1 and then enters the second indoor heat exchanger 8 through the four-way valve 2. The refrigerant that has entered the second indoor heat exchanger 8 will also enter the first indoor heat exchanger 6 through the fully opened PMV 7. In the indoor heat exchangers 6 and 8, the refrigerant emits heat to the air in the room and then liquefies.

The refrigerant from the heat exchangers 6 and 8 passes through the liquid receiver 17, is subjected to pressure reduction in the expansion valve 4 so that it can easily be vaporized, and then enters the refrigerant heater 12. In the heater 12, the refrigerant is heated by the burner 13, so that it vaporizes. The refrigerant from the heater 12 is taken into the compressor 1 through the bypass pipe 19. In this way, a heating cycle is completed.

When the indoor heat exchangers 6 and 8 acts as condensers, while the refrigerant heater 12 act as an evaporator in that way, the room is heated.

At the time of the heating operation, the temperature of the refrigerant entering the heater 12 is sensed by the temperature sensor 24. The temperature of the refrigerant going out of the heater 12 is sensed by the temperature sensor 25. The temperature sensed by the sensor 24 is subtracted from the temperature sensed by the sensor 25, thereby detecting the degree of superheat of the refrigerant in the heater 12. The quantity of heat applied to the heater 12 is controlled so that the degree of superheat should be kept constant (step 213).

When the room temperature Ta rises to or above the set value Ts (Ta≧Ts in step 203), the compressor 1, the outdoor fan 10 and the refrigerant heater 12 are stopped (steps 214 to 216). That is, the heating operation is interrupted.

When the room temperature Ta falls below the set value Ts (Ta<Ts in step 203), the heating operation is resumed.

When a stopping operation is performed at the operating unit 31 (step 217), the compressor 1, the indoor fan 10 and the refrigerant heater 12 are stopped (step 218). Further, the four-way valve 2, the PMV 7 and the two-way valves 5, 20 and 22 are placed in neutral (step 219). That is, the heating operation is stopped.

Suppose that, at the operating unit 31, a cooling operation mode is set, and a starting operation is performed (steps 201 and 220).

If, at this point, the room temperature Ta sensed by the sensor 32 is higher than the set value Ts (Ta>Ts in step 221), then the compressor 1 is operated, the four-way valve 2 is set in neutral, the two-way valve 5 is closed, the PMV 7 is fully opened, the outdoor fan 9 is operated, the indoor fan 10 is operated, and the two-way valves 20 and 22 are closed (steps 222 to 229).

As indicated by solid arrows in FIG. 5, therefore, the refrigerant is discharged out of the compressor 1 and then enters the outdoor heat exchanger 3 through the four-way valve 2. The refrigerant that has entered the heat exchanger 3 passes through the check valve 11 and the refrigerant heater 12 that is not in operation, is subjected to pressure reduction in the expansion valve 4 so that it can easily be vaporized and then enters the first indoor heat exchanger 6 through the liquid receiver 17. The refrigerant which has entered will also enter the second indoor heat exchanger 8 through the fully opened PMV 7. In the indoor heat exchangers 6 and 8, the refrigerant absorbs heat from the air in the room and then liquefies. The refrigerant from the indoor heat exchangers 6 and 8 is taken into the compressor 1 through the four-way valve 2. In this way, a cooling cycle is formed.

When the outdoor heat exchanger 3 acts as a condenser, while the indoor heat exchangers 6 and 8 act as evaporators in that way, the room is cooled.

When the room temperature Ts falls to or below the set value Ts (Ta≦Ts in step 221), the compressor 1 and the outdoor fan 9 are stopped (steps 230 and 231). That is, the cooling operation is interrupted.

Subsequently, when the room temperature Ta goes higher than the set value Ts (Ta>Ts in step 221), the cooling operation is resumed.

Suppose that a dehumidifying operation mode is set at the operating unit (step 232).

Then, the compressor 1 is operated, the four-way valve 2 is placed in neutral, the two-way valve 5 is opened, the opening of the PMV 7 is decreased, the indoor fan 10 is operated, and the two-way valve 20 is closed (steps 233 to 238).

Therefore, the refrigerant is discharged out of the compressor 1 and then enters the outdoor heat exchanger 3 through the four-way valve 2. The refrigerant that has entered the heat exchanger 3 passes through the check valve 11 and the refrigerant heater 12, and then enters the first indoor heat exchanger 6 through the two-way valve 5 (the expansion valve 4 is bypassed). In the heat exchanger 6, the refrigerant emits heat to the air in the room and then liquefies. The refrigerant from the first indoor heat exchanger 6 is subjected to pressure reduction in the PMV 7 so that it can easily be vaporized, and then enters the second indoor heat exchanger 8. In the indoor heat exchanger 8, the refrigerant absorbs heat from the air in the room and then liquefies. The refrigerant from the indoor heat exchanger 8 is taken into the compressor 1 through the four-way valve 2.

In that way, a dehumidifying cycle is formed, in which the first indoor heat exchanger 6 acts as a condenser (reheater), while the second indoor heat exchanger 8 act as an evaporator. The air in the room is cooled and dehumidified by the second indoor heat exchanger 8 and then discharged into the room after being reheated by the first indoor heat exchanger 6.

At the time of the dehumidifying operation, a comparison is made between the room temperature Ta sensed by the temperature sensor 32 and the set value Ts (step 239). This permits a selection to be made out of the dehumidifying operation on the heating side, the isothermal dehumidifying operation, and the dehumidifying operation on the cooling side.

For example, when the room temperature Ta is lower than the set value Ts (Ta<Ts), the dehumidifying operation on the heating side is selected. In this type of operation, the outdoor fan 9 is stopped, the refrigerant heater 12 is operated with a small quantity of heat, and the two-way valve 22 is opened (steps 240 to 242). In this case, since no air passes through the outdoor heat exchanger 3, the heat radiation from the refrigerant in the outdoor heat exchanger decreases and the quantity of heat applied to the reheater (first indoor heat exchanger 6) correspondingly increases. Besides, since the bypass pipe 21 is opened, part of the high-temperature refrigerant discharged out of the compressor 1 is applied to the reheater 6 as auxiliary heat. Thus, the air cooled and dehumidified by the first indoor heat exchanger 8 is heated up to a temperature higher than the room temperature Ta and then discharged into the room. It is to be noted that the operation of the refrigerant heater 12 is intended to compensate for the heat loss due to natural convection in the outdoor heat exchanger 3.

When the room temperature Ta is substantially equal to the set value Ts (Ta=Ts), the isothermal dehumidifying operation is selected. In this type of operation, the outdoor fan 9 is operated at a very low speed, the refrigerant heater 12 is operated with a very small quantity of heat, and the two-way valve 22 is closed (steps 243 to 245). In this case, the heat radiation from the refrigerant in the outdoor heat exchanger 3 is slightly increased, and the quantity of heat applied to the reheater 6 decreases correspondingly. Moreover, since the bypass pipe 21 is closed, part of the high-temperature refrigerant discharged out of the compressor 1 is not applied to the reheater 6 as auxiliary heat. Thus, the air cooled and dehumidified by the first indoor heat exchanger 8 is discharged into the room after being heated up to a temperature substantially equal to the room temperature Ta.

When the room temperature Ta is higher than the set value Ts (Ta>Ts), the dehumidifying operation on the cooling side is selected. With this type of operation, the outdoor fan 9 is operated at a speed higher than the very low speed, the refrigerant heater 12 is stopped, and the two-way valve 22 is closed (steps 246 to 248). In this case, the heat radiation from the refrigerant in the outdoor heat exchanger 3 increases, and the quantity of heat applied to the reheater 6 decreases correspondingly. Besides, since the bypass pipe 21 is closed, part of the high-temperature refrigerant discharged out of the compressor 1 is not applied to the reheater 6 as auxiliary heat. Thus, the air cooled and dehumidified by the first indoor heat exchanger 8 is discharged into the room with its temperature slightly raised.

As described above, at the time of the dehumidifying operation, by controlling the speed of the outdoor fan 9 and the operation of the refrigerant heater 12 so as to regulate the temperature of the dehumidified air (air discharged into the room), the room can be maintained at a most comfortable temperature. Besides, since the range of variations of the speed of the outdoor fan 9 and the range of variations of the quantity of heat applied to the refrigerant heater 12 are both narrow, the temperature of the room is allowed to vary gently. This is also comfortable.

Moreover, since the functions of the first and second indoor heat exchangers 6 and 8 are changed by adjusting the opening of the PMV 7, the flow of the refrigerant will be slow when their functions are changed, producing no unpleasant refrigerant sound.

Furthermore, since the dehumidifying operation on the heating side can be performed without switching the four-way valve 2, the generation of refrigerant sound resulting from switching of the four-way valve 2 will be avoided.

In the second embodiment, the expansion valve 4 may be replaced with an electronic expansion valve. In this case, the opening of the electronic expansion valve is decreased at the times of the cooling and heating operations but is fully opened at the time of the dehumidifying operation. This arrangement will eliminate the need for the two-way valve 5.

Figure 7:
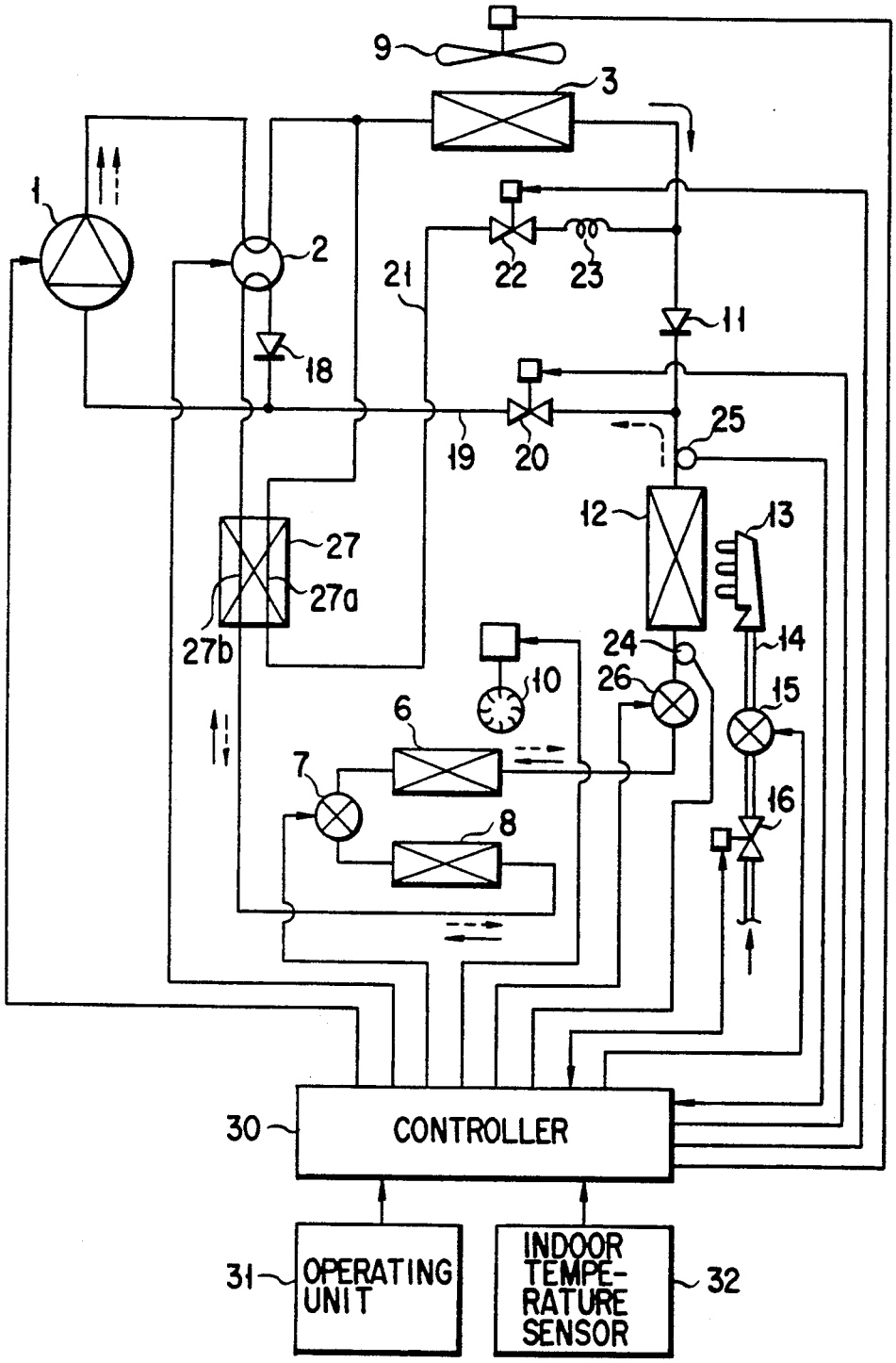
FIG. 7 illustrates a refrigeration cycle and a control circuit according to a third embodiment of the present invention.

Next, a third embodiment of the present invention will be described with reference to FIG. 7. In FIG. 7, like reference numerals are used to designate corresponding parts to those in FIG. 5, and their detailed description is omitted.

An electronic expansion valve 26 is provided in place of the expansion valve 4. The electronic expansion valve 26 is a pulse motor valve whose opening continuously varies with the number of drive pulses applied thereto. Hereinafter, the electronic expansion valve 26 is referred to as the PMV. The use of the PMV 26 allows the two-way valve 5 and the liquid receiver 17 to be removed.

Bypass pipe 21 has its one end connected with the pipe between the four-way valve 2 and the outdoor heat exchanger 3 and its other end connected with the pipe between the outdoor heat exchanger 3 and the check valve 11.

A passage 27*a* of an overall heat transfer type heat exchanger 27 is inserted in the bypass pipe 21 which is equipped with the two-way valve 22 and the capillary tube 23. The other passage 27*b* of the heat exchanger 27 is inserted in the pipe between the second indoor heat exchanger 8 and the four-way valve 2. The overall heat transfer type heat exchanger 27 functions to make an exchange of heat between the refrigerant flowing through the passage 27*a* and the refrigerant flowing through the passage 27*b*.

The controller 30 is equipped with the following functional means.

[1] A means of performing cooling operation by operating the compressor 1, returning the refrigerant discharged out of the compressor 1 back to the compressor 1 through four-way valve 2, outdoor heat exchanger 3, check valve 11, refrigerant heater 12, PMV 26, first indoor heat exchanger 6, PMV 7, second indoor heat exchanger 8, passage 27*a* of overall heat transfer type heat exchanger 27, four-way valve 2, and check valve 18, stopping the refrigerant heater 12 (the burner 13 is non-fired), decreasing the opening of the PMV 26, and fully opening the PMV 7.

[2] A means of performing dehumidifying operation by operating the compressor 1, returning the refrigerant discharged out of the compressor 1 back to the compressor 1 through four-way valve 2, outdoor heat exchanger 3, check valve 11, refrigerant heater 12, PMV 26, first indoor heat exchanger 6, PMV 7, second indoor heat exchanger 8, passage 27*a* of overall heat transfer type heat exchanger 27, four-way valve 2, and check valve 18, fully opening the PMV 26, and decreasing the opening of the PMV 7.

[3] A means of, at the time of dehumidifying operation, regulating the temperature of the dehumidified air by controlling the speed of the outdoor fan 9 and the operation of the refrigerant heater 12 (firing of the burner 13).

[4] A means of, at the time of the dehumidifying operation, stopping the operation when the temperature (the temperature of the refrigerant going out of the heater 12) sensed by the sensor 24 rises abnormally.

[5] A means of performing heating operation by operating the compressor 1, returning the refrigerant discharged out of the compressor 1 back to the compressor 1 through four-way valve 2, passage 27*a* of overall heat transfer type heat exchanger 27, second indoor heat exchanger 8, PMV 7, first indoor heat exchanger 8, PMV 7, first indoor heat exchanger 6, PMV 26, refrigerant heater 12, and bypass pipe 19 (two way valve 20 is opened), fully opening the PMV 7, decreasing the opening of the PMV 26, and operating the refrigerant heater 12.

[6] A means of, at the time of the heating operation, detecting the degree of superheat of the refrigerant that corresponds to a difference between the temperature of the refrigerant entering the heater 12 that is sensed by the sensor 24 and the temperature of the refrigerant going out of the heater 12 that is sensed by the sensor 25.

[7] A means of controlling the quantity of heat applied to the refrigerant heater 12 by adjusting the opening of the proportional control valve 15 so that the degree of superheat should be kept constant.

Figure 8A:
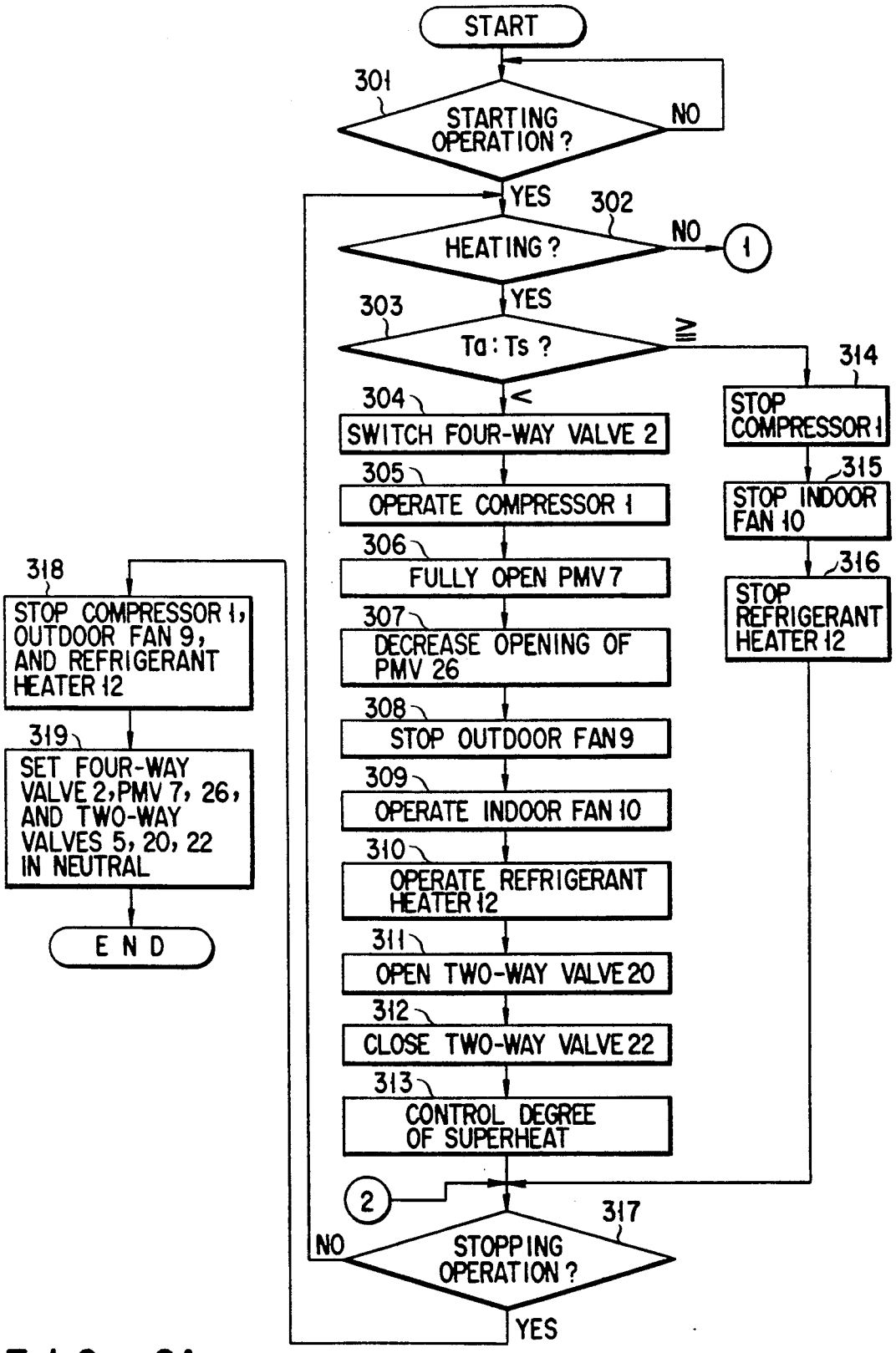
FIGS. 8A, 8B and 8C are a flowchart illustrating the operation of the third embodiment.
Figure 8B:
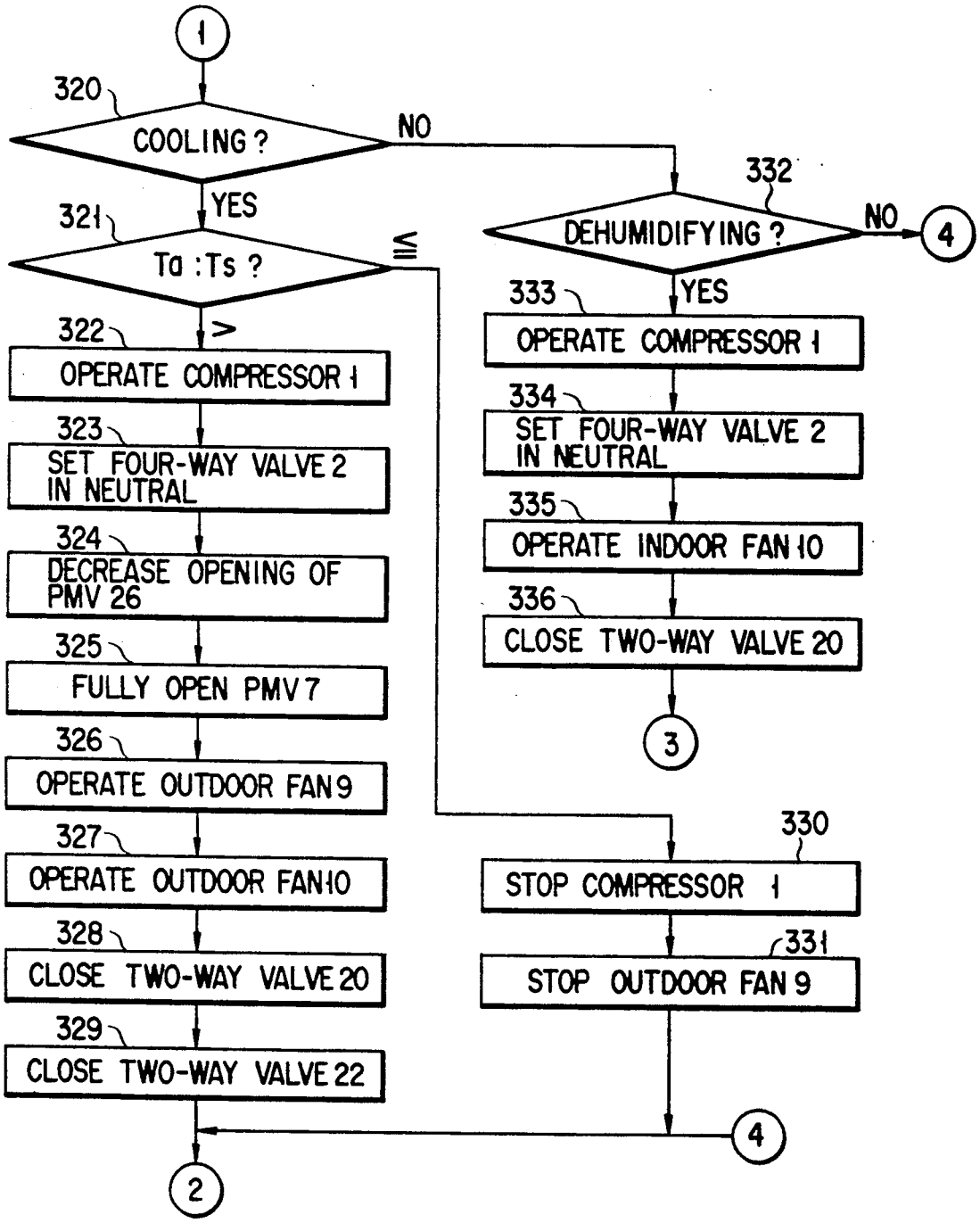
Figure 8C:
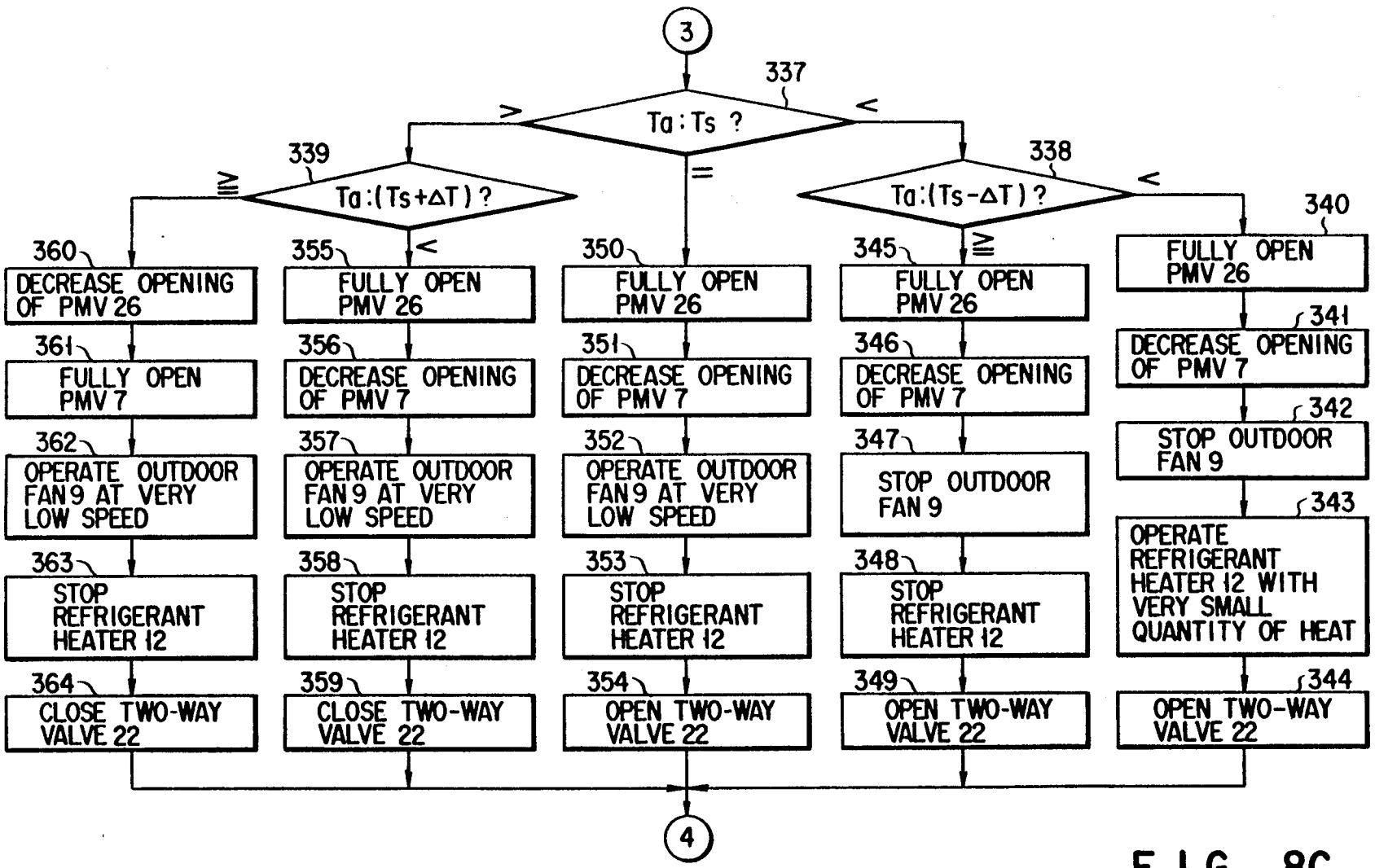

Next, the operation of the above system will be described with reference to a flowchart of FIGS. 8A, 8B and 8C.

Suppose that a heating operation mode and a desired room temperature Ts is set, and a starting operation is performed at the operating unit 31 (steps 301 and 302). Hereinafter, Ts is referred to as the set value.

If, at this point, the room temperature Ta sensed by the indoor temperature sensor 32 is lower than the set value Ts (Ta<Ts in step 303), then the four-way valve 2 is switched, the compressor 1 is operated, the PMV 7 is fully opened, the opening of the PMV 26 is decreased, the outdoor fan 9 is stopped, the indoor fan 10 is operated, the refrigerant heater 12 is operated (the burner 13 is fired), the two-way valve 20 is opened, and the two way valve 22 is closed (steps 304 to 312).

As indicated by broken arrows in FIG. 7, therefore, the refrigerant is discharged out of the compressor 1 and then enters the second indoor heat exchanger 8 through the four-way valve 2 and the passage 27*b* of the overall heat transfer type heat exchanger 27. The refrigerant that has entered the second indoor heat exchanger 8 will also enter the first indoor heat exchanger 6 through the fully opened PMV 7. In the indoor heat exchangers 6 and 8, the refrigerant emits heat to the air in the room and then liquefies.

The refrigerant from the heat exchangers 6 and 8 is subjected to pressure reduction in the PMV 26 so that it can be vaporized easily, and then enters the refrigerant heater 12. In the heater 12, the refrigerant is heated by the burner 13, so that it vaporizes. The refrigerant from the heater 12 is taken into the compressor 1 through the bypass pipe 19. In this way, a heating cycle is completed.

The room is heated when the indoor heat exchangers 6 and 8 acts as condensers, while the refrigerant heater 12 act as an evaporator in that way.

At the time of the heating operation, the temperature of the refrigerant entering the heater 12 is sensed by the temperature sensor 24. The temperature of the refrigerant going out of the heater 12 is sensed by the temperature sensor 25. The temperature sensed by the sensor 24 is subtracted from the temperature sensed by the sensor 25, thereby detecting the degree of superheat of the refrigerant in the heater 12. The quantity of heat applied to the heater is controlled so that the degree of superheat should be kept constant (step 313).

When the room temperature Ta rises to or above the set value Ts ($Ta \geqq Ts$ in step 303), the compressor 1, the outdoor fan 10 and the refrigerant heater 12 are stopped (steps 314 to 316). That is, the heating operation is interrupted.

Subsequently, when the room temperature Ta falls below the set value Ts ($Ta < Ts$ in step 303), the heating operation is resumed.

When a stopping operation is performed at the operating unit 31 (step 317), the compressor 1, the indoor fan 10 and the refrigerant heater 12 are stopped (step 318). Further, the four-way valve 2, the PMVs 7 and 26, and the two-way valves 5, 20 and 22 are placed in neutral (step 319). That is, the heating operation is stopped.

Suppose that, at the operating unit 31, a cooling operation mode is set, and a starting operation is performed (steps 301 and 320).

If, at this point, the room temperature Ta sensed by the sensor 32 is higher than the set value Ts ($Ta > Ts$ in step 321), then the compressor 1 is operated, the four-way valve 2 is set in neutral, the opening of the PMV 26 is decreased, the PMV 7 is fully opened, the outdoor fan 9 is operated, the indoor fan 10 is operated, and the two-way valves 20 and 22 are closed (steps 322 to 329).

As indicated by solid arrows in FIG. 7, therefore, the refrigerant is discharged out of the compressor 1 and then enters the outdoor heat exchanger 3 through the four-way valve 2. The refrigerant that has entered the heat exchanger 3 passes through the check valve 11 and the refrigerant heater 12 that is not in operation, and then enters the first indoor heat exchanger 6 after being subjected to pressure reduction in the PMV 26 so that it can be vaporized easily. The refrigerant which has entered the first indoor heat exchanger 6 will also enter the second indoor heat exchanger 8 through the fully opened PMV 7. In the indoor heat exchangers 6 and 8, the refrigerant absorbs heat from the air in the room and then liquefies. The refrigerant from the indoor heat exchangers 6 and 8 is taken into the compressor 1 through the passage 27*b* of the overall heat transfer type heat exchanger 27, the four-way valve 2 and the check valve 18. In this way, a cooling cycle is formed.

The room is cooled when the outdoor heat exchanger 3 acts as a condenser, while the indoor heat exchangers 6 and 8 act as evaporators in that way.

When the room temperature Ts falls to or below the set value Ts ($Ta \leqq Ts$ in step 321), the compressor 1 and the outdoor fan 9 are stopped (steps 330 and 331). That is, the cooling operation is interrupted.

Subsequently, when the room temperature Ta goes higher than the set value Ts ($Ta > Ts$ in step 321), the cooling operation is resumed.

Suppose that a dehumidifying operation mode is set at the operating unit 31 (step 332).

Then, the compressor 1 is operated, the four-way valve 2 is placed in neutral, the indoor fan 10 is operated, and the two-way valve 20 is closed (steps 333 to 336).

Subsequently, a comparison is made between the room temperature Ta sensed by the indoor temperature sensor 32 and the set value Ts (step 337). Further, a temperature that is $\Delta T$ (a constant value) lower than Ts, i.e., $Ts-\Delta T$, and a temperature that is $\Delta T$ higher than Ts, i.e., $Ts+\Delta T$, are set. The room temperature Ta is compared with the set values ($Ts-\Delta T$) and ($Ts+\Delta T$) (steps 338, 339). This permits a selection to be made out of the dehumidifying operation on the heating side, the dehumidifying operation on the weak heating side, the isothermal dehumidifying operation, the dehumidifying operation on the weak cooling side, and the dehumidifying operation on the cooling side.

When the room temperature Ta is lower than the set value $Ts-\Delta T$ ($Ta < (Ts-\Delta T)$), the dehumidifying operation on the heating side is selected. In this type of operation, the PMV 26 is fully opened, the opening of the PMV 7 is decreased, the outdoor fan 9 is stopped, the refrigerant heater 12 is operated with a very small quantity of heat, and the two-way valve 22 is opened (steps 340 to 344).

Therefore, the refrigerant is discharged out of the compressor 1 and then enters the outdoor heat exchanger 3 through the four-way valve 2. The refrigerant then passes through the check valve 11 to enter the refrigerant heater 12 where it is slightly heated. The refrigerant from the heater passes through the fully opened PMV 26 and then enters the first indoor heat exchanger 6 where it emits heat to the air in the room and then liquefies. The refrigerant from the first indoor heat exchanger 6 enters the second indoor heat exchanger 8 after being subjected to pressure reduction in the PMV 7 so that it can be vaporized easily. In the second indoor heat exchanger 8, the refrigerant absorbs heat from the air in the room and then vaporizes. The refrigerant from the heat exchanger 8 is taken into the compressor 1 through the passage 27*b* of the overall heat transfer type heat exchanger 27, the four-way valve 2, and the check valve 18. Part of the refrigerant that is going to enter the outdoor heat exchanger 3 passes through the bypass pipe 21 while bypassing the outdoor heat exchanger 3 and then flows to the side of the refrigerant heater 12.

That is, a dehumidifying cycle is formed, in which the first indoor heat exchanger 6 functions as a condenser (reheater), and the second indoor heat exchanger 8 functions as an evaporator. The air in the room is cooled and dehumidified by the second indoor heat exchanger 8 and then discharged into the room after being reheated by the first indoor heat exchanger 6.

In this case, since no outdoor air passes through the outdoor heat exchanger 3 and, moreover, part of the refrigerant bypasses the outdoor heat exchanger 3, heat radiation from the refrigerant in the outdoor heat exchanger 3 is little. Besides, the heat of the refrigerant passing through the bypass pipe 21 is absorbed by the refrigerant on the low pressure side in the overall heat transfer type heat exchanger 27, whereby the heat is utilized effectively. Further, the heat of the heater 12 is applied to the refrigerant.

Therefore, the air cooled and dehumidified by the first indoor heat exchanger 8 is discharged into the room after being sufficiently heated up to a temperature higher than the room temperature Ta. Note that the flow of the refrigerant having heat taken by the overall heat transfer type heat exchanger 27 into the refrigerant heater 12 through the bypass pipe 21 will prevent an abnormal increase of the temperature of the refrigerant.

When the room temperature Ta is lower than the set value Ts and moreover equal to or above the set value $(Ts-\Delta T)$, i.e., when $Ts>Ta\geqq(Ts-\Delta T)$, the dehumidifying operation on the weak heating side is selected. In this type of operation, the refrigerant heater 12 is stopped. Other operations are the same as those in the dehumidifying operation on the heating side (steps 345 to 349). That is, the temperature of the air discharged into the room is lower than that in the dehumidifying operation on the heating side because the refrigerant is not heated by the heater 12.

When the room temperature Ta is substantially equal to the set value Ts $(Ta=Ts)$, the isothermal dehumidifying operation is selected. With this type of operation, the outdoor fan 9 is operated at a very low speed, and the heat radiation from the refrigerant in the outdoor heat exchanger 3 slightly increases. Other operations are the same as those in the dehumidifying operation on the weak heating side (steps 350 to 354). That is, the temperature of the air discharged into the room is lower than that in the dehumidifying operation on the weak heating side by an increase in the quantity of heat radiation in the outdoor heat exchanger 3, but is substantially equal to the room temperature Ta.

When the room temperature Ta is higher than the set value Ts but lower than the set value $(Ts+\Delta T)$, i.e., when $(Ts+\Delta T)>Ta>Ts$, the dehumidifying operation on the weak cooling side is selected. With this type of operation, the two-way valve 22 is closed, so that no refrigerant flows through the bypass pipe 21. Other operations are the same as those in the isothermal dehumidifying operation described above (steps 355 to 359).

In this case, the refrigerant does not bypass the outdoor heat exchanger 3, and thus heat radiation from the refrigerant increases in the heat exchanger 3. Thus, the temperature of the air discharged into the room is slightly lower than the room temperature Ta.

When the room temperature Ta is equal to or higher than the set value $(Ts+\Delta T)$, i.e., when $Ta\geqq(Ts+\Delta T)$, the dehumidifying operation on the cooling side is selected. With this type of operation, the opening of the PMV 26 is closed, and the PMV 7 is fully opened. Other operations are the same as those in the dehumidifying operation on the weak cooling side (steps 360 to 364). In other words, the dehumidifying operation on the cooling side is the same as the cooling operation except the outdoor fan 9 is operated at a very low speed.

In this case, since the flow of air from the outdoor fan 9 is little, the heat radiation in the outdoor heat exchanger 3 is less than that at the time of the cooling operation. Therefore, the temperature of the air discharged into the room is higher than in the dehumidifying operation on the weak cooling side but higher than in the cooling operation.

As described above, at the time of the dehumidifying operation, by controlling at least the speed of the outdoor fan 9 and the operation of the refrigerant heater 12 so as to regulate the temperature of the dehumidified air (air discharged into the room), the room can be maintained at a most comfortable temperature. Besides, since the range of variations of the speed of the outdoor fan 9 and the range of variations of the quantity of heat applied to the refrigerant by the refrigerant heater 12 are both narrow, the temperature of the room is allowed to vary gently. This will also be comfortable.

Moreover, since the functions of the first and second indoor heat exchangers 6 and 8 are changed by adjusting the opening of the PMV 7, the flow of the refrigerant will be slow when their functions are changed, producing no unpleasant refrigerant sound.

Furthermore, since the dehumidifying operation on the heating side can be performed without switching the four-way valve 2, the generation of a refrigerant sound resulting from switching of the four-way valve 2 will be avoided.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims and their equivalents.

What is claimed is:

1. An air conditioning apparatus with a function of dehumidifying operation comprising:

a compressor for taking in a refrigerant and discharging it after compression;

an outdoor heat exchanger for exchanging heat between the refrigerant and outdoor air;

an outdoor fan for sending outdoor air to said outdoor heat exchanger;

pressure reducing means for reducing the pressure of the refrigerant;

a first indoor heat exchanger for exchanging heat between the refrigerant and indoor air;

an electronic expansion valve having a variable opening;

a second heat exchanger for exchanging heat between the refrigerant and indoor air;

an indoor fan for circulating indoor air through said first and second indoor heat exchangers;

first means for performing a cooling operation by returning the refrigerant discharged out of said compressor back to said compressor through said outdoor heat exchanger, said pressure reducing means, said first indoor heat exchanger, said electronic expansion valve, and said second indoor heat exchanger, and fully opening said electronic expansion valve;

second means for performing a dehumidifying operation by returning the refrigerant discharged out of said compressor back to said compressor through said outdoor heat exchanger, said first indoor heat exchanger, said electronic expansion valve, and said second indoor heat exchanger, and decreasing the opening of said electronic expansion valve; and third means for, at the time of the dehumidifying operation, controlling the speed of said outdoor fan to thereby regulate the temperature of air discharged into the room.

2. An apparatus according to claim 1, in which said third means controls the speed of said outdoor fan in accordance with the temperature of the air in the room.

3. An apparatus according to claim 1, in which said third means makes a comparison between the temperature of the air in the room and a set value and controls the speed of said outdoor fan on the basis of the result of the comparison.

4. An apparatus according to claim 1, further comprising means for performing a heating operation by returning the refrigerant discharged out of said compressor back to said compressor through said second indoor heat exchanger, said electronic expansion valve, said first indoor heat exchanger, said pressure reducing means, and said outdoor heat exchanger, and fully opening said electronic expansion valve.

5. An air conditioning apparatus with a function of dehumidifying operation comprising:

a compressor for taking in a refrigerant and discharging it after compression;

an outdoor heat exchanger for exchanging heat between the refrigerant and outdoor air;

an outdoor fan for sending outdoor air to said outdoor heat exchanger;

a refrigerant heating device for heating the refrigerant;

pressure reducing means for reducing the pressure of the refrigerant;

a first indoor heat exchanger for exchanging heat between the refrigerant and indoor air;

an electronic expansion valve having a variable opening;

a second heat exchanger for exchanging heat between the refrigerant and indoor air;

an indoor fan for circulating air in the room through said first and second indoor heat exchangers;

first means for performing a cooling operation by returning the refrigerant discharged out of said compressor back to said compressor through said outdoor heat exchanger, said pressure reducing means, said first indoor heat exchanger, said electronic expansion valve, and said second indoor heat exchanger, and fully opening said electronic expansion valve;

second means for performing a dehumidifying operation by returning the refrigerant discharged out of said compressor back to said compressor through said outdoor heat exchanger, said refrigerant heating device, said first indoor heat exchanger, said electronic expansion valve, and said second indoor heat exchanger, and decreasing the opening of said electronic expansion valve; and third means for, at the time of the dehumidifying operation, controlling at least one of the speed of said outdoor fan and the operation of said refrigerant heating device to thereby regulate the temperature of air discharged into the room.

6. An apparatus according to claim 5, in which said third means controls at least one of the speed of said outdoor fan and the operation of said refrigerant heating device in accordance with the temperature of the air in the room.

7. An apparatus according to claim 5, in which said third means makes a comparison between the temperature of the air in the room and a set value and controls at least one of the speed of said outdoor fan and the operation of said refrigerant heating device on the basis of the result of the comparison.

8. An apparatus according to claim 5, further comprising means for performing a heating operation by returning the refrigerant discharged out of said compressor back to said compressor through said second indoor heat exchanger, said electronic expansion valve, said first indoor heat exchanger, said pressure reducing means, and said refrigerant heating device, and fully opening said electronic expansion valve.

9. An apparatus according to claim 8, further comprising means for detecting the degree of superheat of the refrigerant in said refrigerant heating device; and means for controlling the quantity of heat applied to the refrigerant by said refrigerant heating device so that the degree of superheat should be kept constant.

* * * * *